US005848919A

United States Patent [19]

Nagano

[11] Patent Number: 5,848,919

[45] Date of Patent: Dec. 15, 1998

[54] CONNECTOR

[75] Inventor: Toru Nagano, Shizuoka, Japan

[73] Assignee: Yazaki Corporation, Tokyo, Japan

[21] Appl. No.: 924,310

[22] Filed: Sep. 5, 1997

Related U.S. Application Data

[63] Continuation of Ser. No. 604,392, Feb. 21, 1996, abandoned.

[30] Foreign Application Priority Data

Feb. 22, 1995 [JP] Japan ..... 7-033728

[51] Int. Cl.[6] ..... H01R 13/436

[52] U.S. Cl. ..... 439/752; 222/321.8; 222/383.1; 239/333

[58] Field of Search ..... 439/752, 595

[56] References Cited

U.S. PATENT DOCUMENTS 5,252,096 10/1993 Okada ..... 439/752

FOREIGN PATENT DOCUMENTS 5-144499 6/1993 Japan .

*Primary Examiner*—Gary Paumen
*Attorney, Agent, or Firm*—Morgan, Lewis & Bockius LLP

[57] ABSTRACT

A connector for receiving a plurality of terminals includes a housing and a terminal locking member. The housing defines a plurality of terminal accommodating chambers and a cavity formed in an outer wall of the housing, wherein each of the plurality of terminal accommodating chambers accommodates a respective one of the plurality of terminals, and wherein the cavity extends across the terminal accommodating chambers. The terminal locking member is movably disposed in the cavity of the housing, the terminal locking member being movable between a temporary locking position in which the terminal locking member is not engaged with the terminals accommodated in the terminal accommodating chambers and a final locking position in which the terminal locking member is engaged with the terminals, wherein the terminals are retained in the terminal accommodating chambers when the terminal locking member is in the final locking position. The connector further includes a temporary-locking locking section formed on the housing and a flexible arm extending from the terminal locking member. The flexible arm is engageable with the temporary-locking locking section to retain the terminal locking member at the temporary locking position and is forcibly bendable to disengage the flexible arm from the temporary-locking locking section to allow movement of the terminal locking member from the temporary locking position to the final locking position.

5 Claims, 5 Drawing Sheets

CONNECTOR

This application is a continuation of application Ser. No. 08/604,392, filed Feb. 21, 1996, now abandoned.

BACKGROUND OF THE INVENTION

The present invention relates to a connector with a terminal locking member which is engaged with terminals accommodated in the terminal accommodating chambers of the connector thereby to prevent the terminals from coming off the terminal accommodating chambers.

FIG. 5 shows a conventional connector 1 disclosed by Japanese Unexamined Patent Publication No. Hei. 5-144499. The connector 1, as shown in FIG. 5, comprises a housing 9 and a terminal locking member 11. The housing 9 includes upper and lower arrays of a plurality of terminal accommodating chambers 3 and a cavity 7 in the middle of an outer wall 5. The terminal locking member 11 may be set in the cavity 7 of the housing 9 at two positions, namely, a temporary locking position and a final locking position, to lock terminals 23 in the terminal accommodating chambers 3 thereby preventing the terminals 23 from coming out of the terminal accommodating chambers 3.

Of the terminal accommodating chambers 3 of the upper array which are opened in and located behind the cavity 7 of the housing 9, both end ones 3 have each a temporary locking stopper 13 which protrudes from the opening edge thereof. A final locking groove 15 is formed in the lower portion of the temporary locking stopper 13. Of the terminal accommodating chambers 3 of the lower array which are opened in and located in front of the cavity 7, both end ones 3 have each a temporary locking stopper 17 (cf. FIG. 6) which is protruded from the opening edge.

On the other hand, the terminal locking member 11 comprises a main body 27 having two (upper and lower) arrays of terminal inserting holes 25. Protrusions 19 and 21 are extended from the upper rear ends and the lower front ends of each of two side walls of the main body 27, respectively. In each of the terminal inserting holes 25 of the terminal locking member body 27, a locking portion 29 extends from the inner surface of the upper wall. The locking portion 29 functions as follows: When the terminal locking member 11 is positioned at the final locking position of the housing 9, the locking portion 29 is fixedly inserted into a locking hole 23*a* formed in a metal terminal 23, to prevent the latter 23 from coming off the terminal accommodating chamber 3.

As shown in FIG. 7(*a*), the terminal locking member 11 is inserted in the cavity 7, so that the protrusions 19 are engaged with the locking stopper 13, while the protrusions 21 are engaged with the temporary locking stoppers 17. That is, the terminal locking member 11 is set at the temporary locking position in the housing 9 thus being temporarily locked to the latter 9. Thereafter, as shown in FIG. 7(*b*), the terminal locking member 11 is completely inserted into the cavity 7, so that the protrusions 19 are engaged with the final locking grooves 15; that is, the terminal locking member 11 is set at the final locking position in the housing 9, thus being finally fixedly locked to the latter 9.

If the terminal locking member 11 is temporarily locked to the housing 9, the locking portions 29 are not fixedly engaged with the locking holes 23*a* of the metal terminals 23 set in the terminal accommodating chambers 3. That is, the metal terminals 23 may be removed from the terminal accommodating chambers 3, or inserted into the latter 3.

After the metal terminals 23 have been set in the terminal accommodating chambers 3, the terminal locking member 11 is shifted to the final locking position, so that the locking portions 29 are fixedly engaged with the locking holes 23*a* of the metal terminals 23. As a result, the metal terminals 23 are positively prevented from being removed from the terminal accommodating chambers 3. Furthermore, because the terminal locking member 11 cannot be moved from the temporary locking position to the final locking position, it can be detected that the metal terminals 23 have not been inserted into the respective terminal accommodating members 3.

However, the above-described connector 1 is disadvantageous in the following points: If, during the transportation of the connector 1 with the terminal locking member 11 temporarily locked to the housing 9, the terminal locking member 11 may be inadvertently pushed towards the housing 9 or depressed by shock, thereby causing the terminal locking member 11 to be shifted from the temporary locking position to the final locking position.

In addition, if, when it is required to set the terminal locking member 11 at the temporary locking position in the housing 9, an excessively great force is applied, then the terminal locking member may be set at the final locking position in the housing.

If this trouble occurs, then in setting the metal terminals 23 in the terminal accommodating chambers 3, it is necessary to return the terminal locking member 11 from the final locking position to the temporary locking position. As a result, the number of wasteful work steps is increased.

SUMMARY OF THE INVENTION

In view of the foregoing, an object of the invention is to provide a connector which is free from the difficulty that the terminal locking member may be unintentionally moved from the temporary locking position to the final locking position.

In order to achieve the foregoing object of the invention, according to a first aspect of the invention, a connector comprises a housing which has a plurality of terminal accommodating chambers, and a cavity formed in one outer wall thereof in such a manner that the cavity is extended vertically across the terminal accommodating chamber; and a terminal locking member which is disposed in the cavity of the housing and which may be set at a temporary locking position in the cavity of the housing where the terminal locking member is not engaged with metal terminals which are accommodated in the terminal accommodating chambers, respectively, and then at a final locking position where the terminal locking member engages with the metal terminals to prevent the latter from coming off the terminal accommodating chamber, wherein the connector further comprises: temporary locking position holding means which locks the terminal locking member at the temporary locking position in the housing, to prevent the terminal locking member from moving to the final locking position, and which, when the terminal locking means at the temporary position is forcibly disengaged from the housing, permits the terminal locking member to move to the final locking position.

According to a second aspect of the invention, in the above connector, the temporary locking position holding means comprises: a temporary-locking locking section formed on the housing; and a flexible arm which is protruded from the terminal locking member, and has a locking portion at the end which engages with the temporary-locking locking section to hold the terminal locking member at the temporary locking position, the flexible arm being forcibly bent so as to be disengaged from the temporary-locking locking section, thereby to allow the terminal locking member to move to the final locking position.

According to a third aspect of the invention, in the connector of the second aspect, the flexible arm has the locking portion and an operating portion, and is formed on each of both side walls of the terminal locking member.

According to a fourth aspect of the invention, a connector comprises a housing which has a plurality of terminal accommodating chambers, and a cavity formed in one outer wall thereof in such a manner that the cavity is extended vertically across the terminal accommodating chamber, and a terminal locking member which is disposed in the cavity of the housing and which may be set at a temporary locking position in the cavity of the housing where the terminal locking member is not engaged with the metal terminals which are accommodated in the terminal accommodating chambers, respectively, and then at a final locking position where the terminal locking member engages with the metal terminals to prevent the metal terminals from moving to the terminal accommodating chamber, wherein the housing has a temporary-locking locking section, a temporary locking protrusion, and a final locking recess, and the terminal locking member has: a temporary locking stopper which engages with the temporary locking protrusion to prevent the terminal locking member from coming off the cavity; and a flexible arm having a locking portion at the end which is engaged with the temporary-locking locking section to lock the terminal locking member at the temporary locking position, and engages with the final locking recess to lock the terminal locking member at the final locking position.

The connector of the first aspect functions as follows: When the terminal locking member is set at the temporary locking position in the housing, the temporary-locking position holding means prevents the terminal locking member from being shifted from the temporary locking position to the final locking position. In order to set the terminal locking member at the final locking position, the temporary-locking position holding means are forcibly operated to shift the terminal locking member from the temporary locking position in the housing, and the terminal locking member is pushed in the cavity of the housing. Hence, the terminal locking member will never be unintentionally moved from the temporary locking position to the final locking position.

The connector of the second aspect functions as follows: When the terminal locking member is set at the temporary locking position in the housing, the locking portions of the flexible arms are engaged with the temporary-locking locking sections of the housing, to hold the terminal locking member at the temporary locking position. Under this condition, the flexible arms are forcibly bent to disengage the locking portions from the temporary-locking locking sections, thereby to push the terminal lock member into the cavity of the housing until it is set at the final locking position.

The connector of the third aspect functions as follows: The flexible arms provided on both side walls of the terminal locking means are forcibly bent by holding the operating portions of the flexible arm, so that the temporary-locking locking sections are disengaged from the locking portions.

The connector of the fourth aspect functions as follows: When the terminal locking member is set at the temporary locking position in the housing, the temporary locking protrusions of the housing are engaged with the temporary locking stoppers of the terminal locking member, while the temporary-locking locking sections of the housing are engaged with the locking portions of the flexible arms, so that the terminal locking member is held at the temporary locking position in the housing. Under this condition, the flexible arms are forcibly bent to disengage the locking portions from the temporary-locking locking section, and the terminal locking member is further pushed into the cavity until it is set at the final locking position in the housing. Under this condition, the locking portions are engaged with the final locking recesses, to fix the terminal locking member at the final locking position. The terminal locking member will never be unintentionally moved from the temporary locking position to the final locking position.

DETAILED DESCRIPTION OF THE INVENTION

Figure 1:
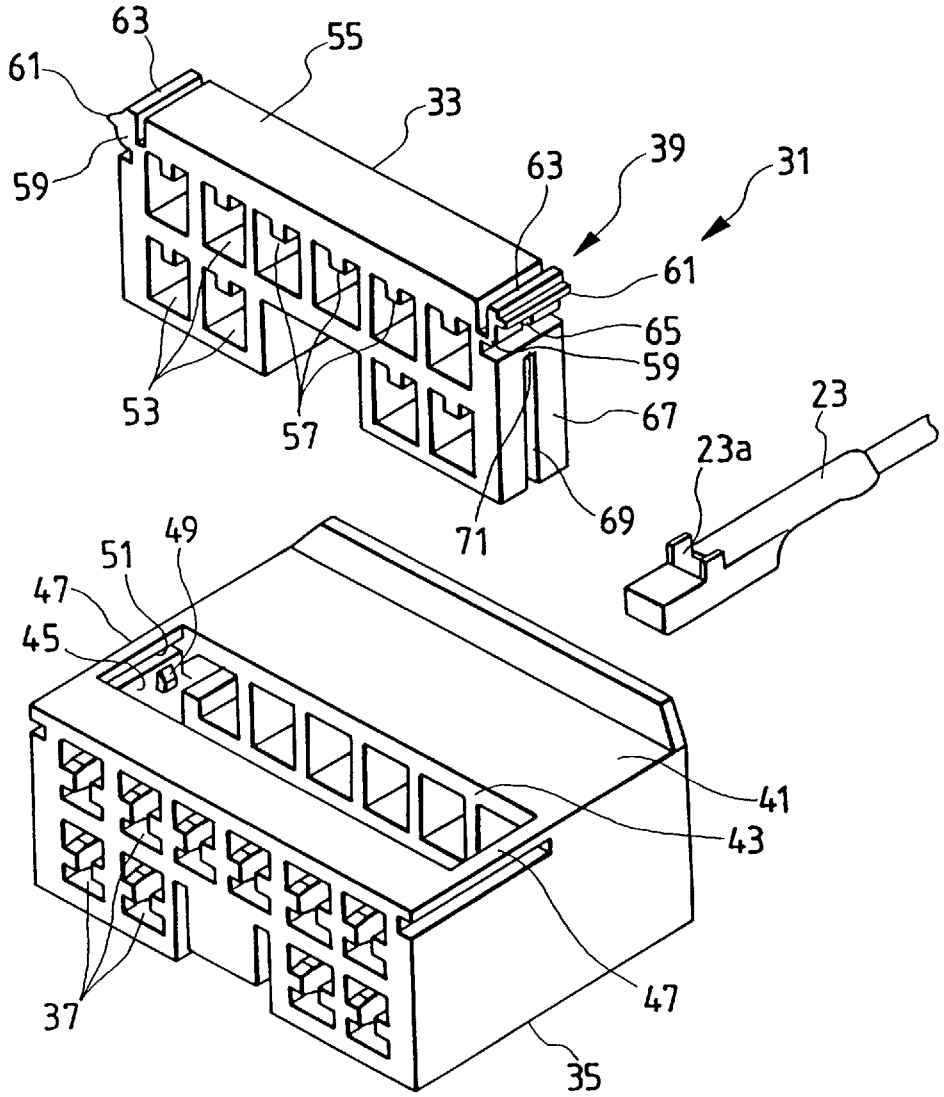
FIG. 1 is an exploded perspective view of a connector, according to a preferred embodiment of the invention.
Figure 2A:
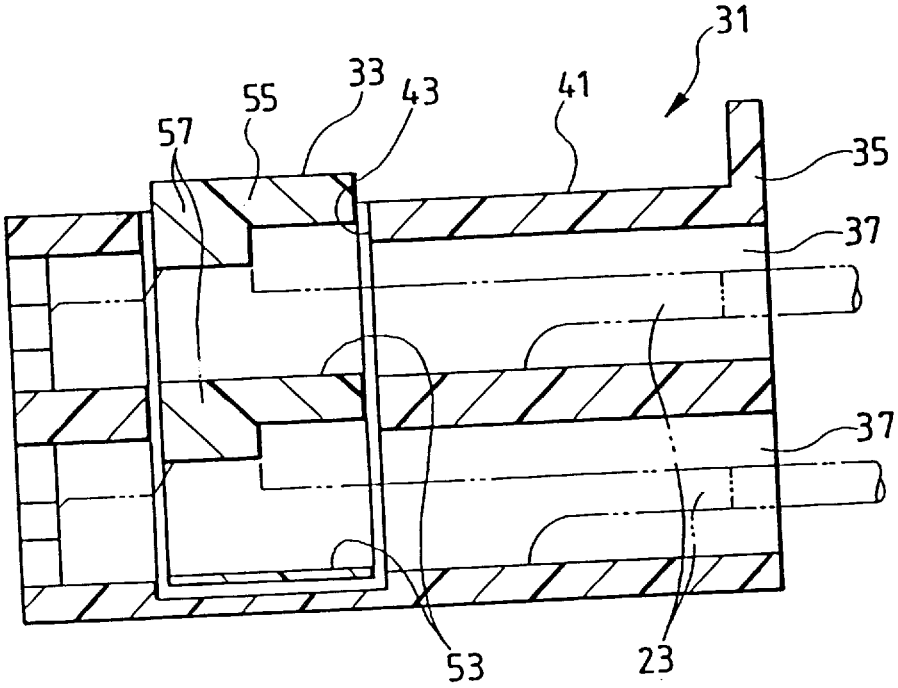
FIGS. 2(*a*) and 2(*b*) are for a description of the relationships between a housing and a terminal locking member in the connector, wherein FIG. 2(*a*) is a sectional view showing a terminal locking member set at a temporary locking position in a housing, and FIG. 2(*b*) is a sectional view showing the terminal locking member which is set at a final locking position in the housing.
Figure 2B:
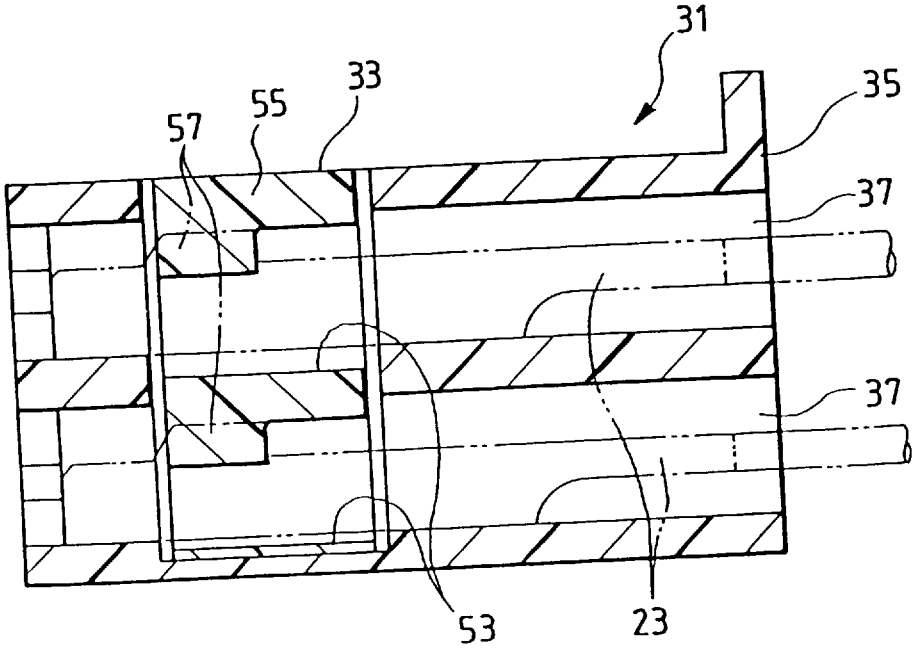
Figure 3C:
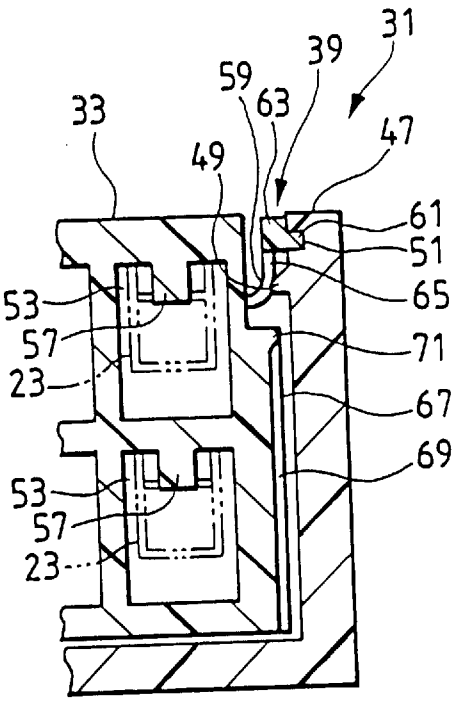
FIGS. 3(*a*) to 3(*c*) show a procedure of shifting the terminal locking member from the temporary locking position to the final locking position in the housing, wherein FIG. 3(*a*) is a sectional view showing the terminal locking member at the temporary locking position, FIG. 3(*b*) is a sectional view showing a flexible arm which has been forcibly bent, and FIG. 3(*c*) is a sectional view showing the terminal locking member set at the final locking position.
Figure 3B:
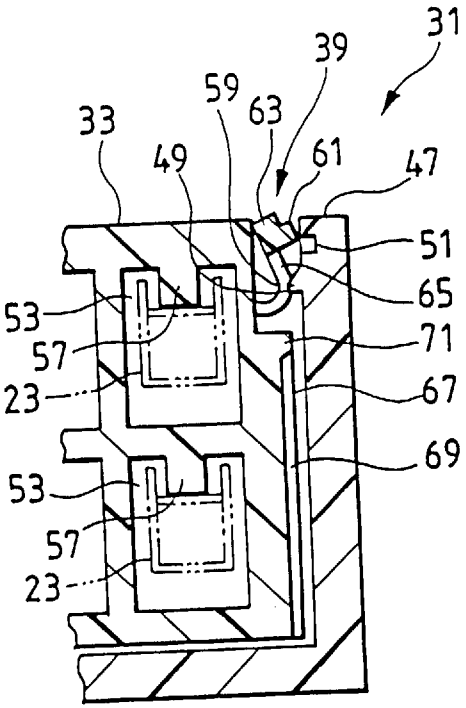
Figure 3A:
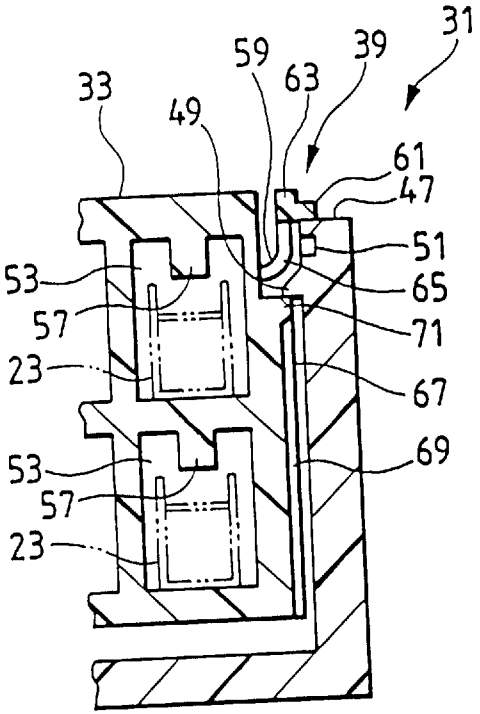
Figure 4C:
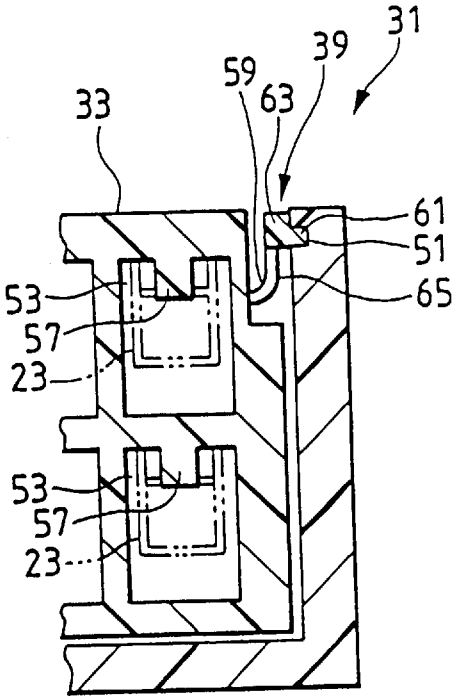
FIGS. 4(*a*) to 4(*c*) show procedures of moving the terminal locking member from the temporary locking position to the final locking position, wherein FIG. 4(*a*) is a sectional view showing a terminal locking member set at the temporary locking position, FIG. 4(*b*) is a sectional view showing the arm which has been forcibly bent, and FIG. 4(*c*) is a sectional view showing the terminal locking member which is set at the final locking position.
Figure 4B:
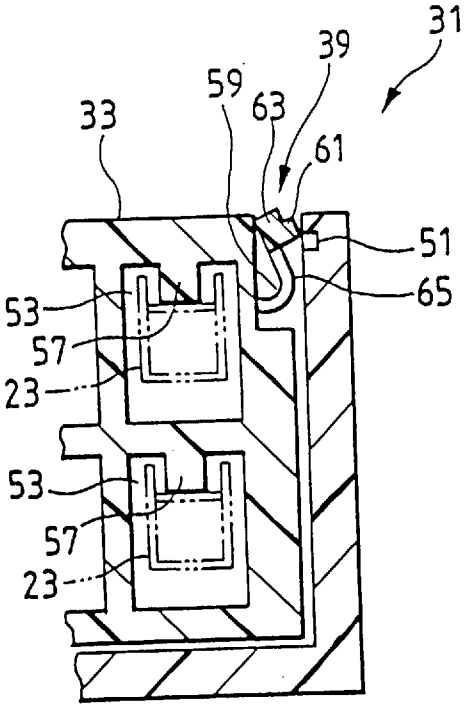
Figure 4A:
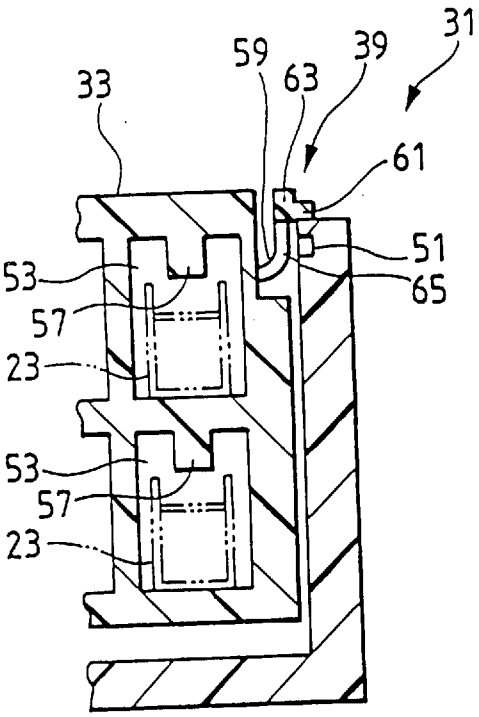
Figure 5:
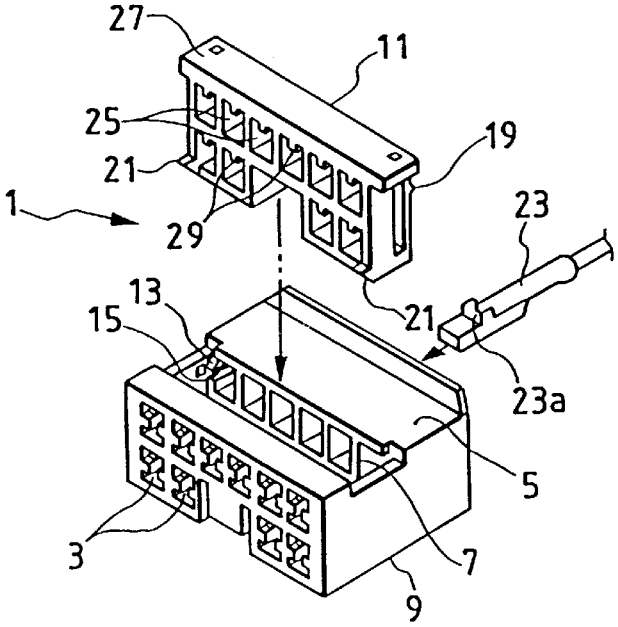
FIG. 5 PRIOR ART
FIG. 5 is an exploded perspective view showing a conventional connector with a terminal locking member.
Figure 7A:
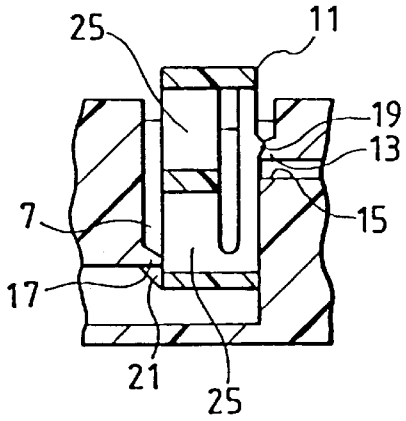
FIG. 7(a) PRIOR ART
FIGS. 7(*a*) and 7(*b*) illustrate the relationship between the terminal locking member and the housing in the conventional connector shown in FIG. 5, wherein FIG. 7(*a*) is a sectional view showing the terminal locking member set at the temporary locking position in the housing, and FIG. 7(*b*) is a sectional view showing the terminal locking member which is set at the final locking position in the housing.
Figure 6:
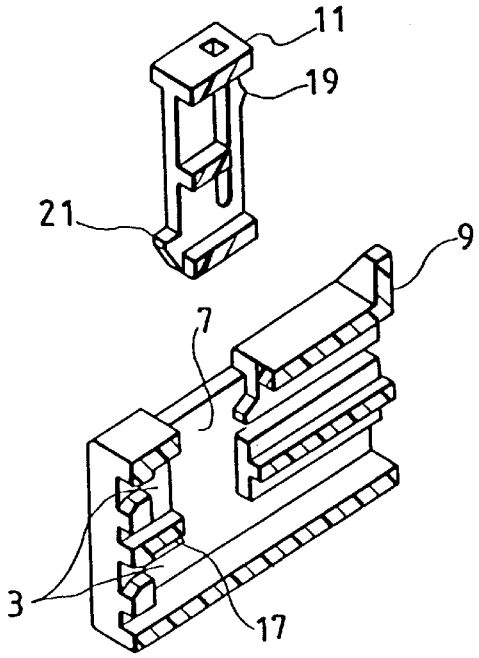
FIG. 6 PRIOR ART
FIG. 6 is a perspective view, with parts cut away, showing the relationships between a housing and the terminal locking member in the conventional connector shown in FIG. 5.
Figure 7B:
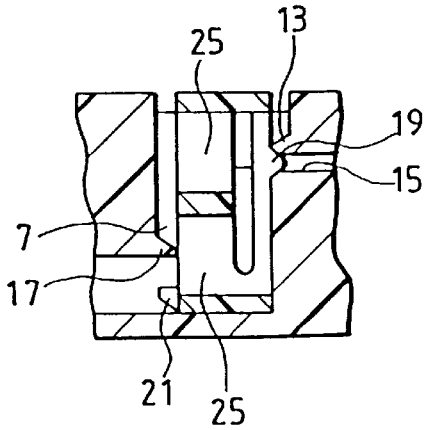
FIG. 7(b) PRIOR ART

A connector, which constitutes one embodiment of the present invention, will be described with reference to the accompanying drawings. FIG. 1 is an exploded perspective view of the connector 31 according to the invention. FIGS. 2(*a*) and 2(*b*) show the inside of the connector 31. Specifically, FIG. 2(*a*) shows a sectional view showing a terminal locking member 33 which is set at a temporary locking position in a housing 35, and FIG. 2(*b*) shows a sectional view of the terminal locking member 33 which is set at a final locking position in the housing 35. FIGS. 3(*a*) to 3(*c*), and FIGS. 4(*a*) to 4(*c*) are sectional views which describe the a procedure of shifting of the terminal locking member 33 from the temporary locking position to the final locking position.

The connector 1, as shown in FIG. 1, comprises the aforementioned housing 35 in which two (upper and lower) arrays of terminal accommodating chambers 37, in which metal terminals 23 are respectively set, are formed; and the aforementioned terminal locking member 33 which is fitted in the housing 35 and engaged with the metal terminals 23 in the terminal accommodating chambers 37 to prevent the metal terminals 23 from coming off the latter 37. The connector 31 includes temporary locking position holding means 39 which locks the terminal locking member 33 at the temporary locking position in the housing 35, to prevent it from shifting to the final locking position. After forcibly disengaging the terminal locking member 33 from the housing 35, temporary locking position holding means 39 allows the terminal locking member 33 to move to the final locking position.

The housing 35 has an opening in the middle of its one outer wall (top wall) 41, and a cavity 43 which extends across the partition walls of the terminal accommodating chambers 37. The cavity 43 is defined by a pair of walls 45 which confront each other (only one inner wall 45 shown in FIG. 1). A pair of temporary-locking locking sections 47 are formed along the upper edges of the pair of walls 45, respectively. A pair of temporary locking protrusions 49 are extend from the inner surface of the confronted walls 45 of the cavity 43, respectively. Above the temporary locking protrusions 49 and 49, final locking recesses 51 are formed in such a manner that they are extend in the direction of insertion of the metal terminals 23 into the terminal accommodating chambers 37.

The terminal locking member 33 may be set at the temporary locking position in the cavity 43 as follows: First, the terminal locking member 33 is fitted in the cavity 43. Next, the temporary-locking locking sections 47 are engaged with locking portions 61 and 62 of flexible arms 59 (described later), and the temporary locking protrusions 49 are engaged with temporary locking stoppers 71 (described later) which are provided on the terminal locking member 33. Thus, the terminal locking member 33 is set at the temporary locking position in the cavity 43 as shown in FIG. 2(*a*). Thereafter, when the final locking recesses 51 are engaged with locking portions 61 which are formed on the flexible arms 59 (described later), the terminal locking member 33 is fixedly set at the final locking position in the cavity 43.

The terminal locking member 33 has a locking main body 55 in which upper and lower arrays of terminal inserting holes 53 passing through the locking member in the forward and backward direction are formed. The terminal inserting holes 53 have locking protrusions 57 which are extended from their upper surfaces, respectively. Those locking protrusions 57 are engaged with the locking recesses 23*a* of the metal terminals 23 when the terminal locking member 33 is set at the final locking position in the cavity 43.

A pair of flexible arms 59 and 59 are extend from both side walls of the locking main body 55 in the width direction in such a manner that they are protruded upwardly. The flexible arms 59 and the aforementioned temporary-locking locking section 47 form the aforementioned temporary position holding means 39. The outer end portion of each of the arms 59 is formed into a locking portion 61 which extends along in the width, and an operating portion 63 is formed at the upper end portion of the locking portion 61. In addition, each of the arms 59 has a relief groove 65 in the middle in the forward and backward direction. The locking main body 55 has side walls 67 respectively below the arms 59. Each of the side walls 67 has also a relief slit 69 which is aligned with the relief groove 65. The upper ends of the relief slits 69 serve as temporary locking stoppers 71 which engage with the above-described temporary locking protrusions 49, respectively.

A procedure of fixing the terminal locking member 33 in the housing 35 will now be described with reference to FIGS. 3(*a*) to 4(*c*). Here FIGS. 4(*a*) to 4(*c*), unlike FIGS. 3(*a*) to 3(*c*), show the arm 59 with the temporary locking protrusion 49 and the temporary locking stopper 71 omitted.

As shown in FIGS. 3(*a*) and 4(*a*), the terminal locking member 33 is inserted into the cavity 43 of the housing 35, so that the lower portions of the temporary locking protrusions 49 are engaged with the temporary locking stoppers 71, while the locking portions 61 of the flexible arms 59 are engaged with the temporary-locking locking sections 47 formed along the edges of the opening of the cavity 43. As a result, the upward movement of the terminal locking member 33 is prevented because the temporary locking protrusions 49 have been engaged with the temporary locking stoppers 71. In addition, the downward movement (towards the final locking position) of the terminal locking member 33 is prevented because the temporary-locking locking sections 47 engage with the locking portions 61. Accordingly, the terminal locking member 33 is set in the locked state at the temporary locking position.

Under this condition, the metal terminals 23 are inserted into the terminal accommodating chambers 37, respectively. Thereafter, as shown in FIGS. 3(*b*) and 4(*b*), with the operating portions 63 of the arms 59 forcibly pushed inwardly to bend the arms 59, the terminal locking member 33 is pushed into the cavity 43 while the locking portions 61 are being disengaged from the temporary-locking locking sections 47. When the terminal locking member 33 is pushed into the cavity 43, as shown in FIGS. 3(*c*) and 4(*c*), the locking portions 61 are fit in the final locking recesses 51 by the elasticity of the arms 59. Thus, the terminal locking member 33 is set at the final locking position. Since the locking portions 61 are fit in the final locking recesses 51, the terminal locking member 33 is held at the final locking position. In addition, the locking protrusions 57 of the terminal locking member 33 are engage with the locking recesses 23*a,* thereby preventing the metal terminals 23 from coming off the terminal accommodating chambers 37.

The terminal locking member 33 may be moved from the final locking position to the temporary locking position as follows: With the operating parts 63 caught with a jig for instance, the arms 59 are forcibly bent so that the locking portions 61 disengage from the final locking recesses 51. Under this condition, the terminal locking member 33 is moved upwardly to the temporary locking position.

As is apparent from the above description, in order to shift the terminal locking member 33 from the temporary locking position, it is absolutely necessary to forcibly bend the flexible arms 59 to disengage the locking portions 61 from the temporary-locking locking sections 47 thereby to push it in the cavity 43. Hence, the terminal locking member 33 is positively held at the temporary locking position. Therefore, the terminal locking member 33 is prevented from being unintentionally moved from the temporary locking position to the final locking position in the housing 35.

The terminal locking member 33 will not be carelessly moved from the temporary locking position to the final locking position in the housing 35. This feature eliminates the aforementioned wasteful work of returning the terminal locking member 33 from the final locking position to the temporary locking position.

Furthermore, in the embodiment of the invention, the flexible arms 59 are provided on both side walls of the terminal locking member 33. Hence, the arms 59 can be forcibly bent with the operating portions 63 caught with a jig or the like. Thus, the movement of the terminal locking member from the temporary locking position to the final locking position, or the movement of the terminal locking member from the final locking position to the temporary locking position can be achieved with ease.

As was described above, in the connector of the present invention, in order to move the terminal locking member from the temporary locking position, it is essential to operate the temporary locking position holding means to forcibly disengage the terminal locking member from the housing. Hence, the terminal locking member will not be unintentionally moved from the temporary locking position to the final locking position.

Also, in the connector of the present invention, in order to move the terminal locking member from the temporary locking position in the housing, it is essential to forcibly bend the flexible arms to disengage the locking portions from the temporary-locking locking sections of the housing. Hence, the terminal locking member will not be unintentionally moved from the temporary locking position to the final locking position.

Further, in the connector of the invention, the terminal locking member is set at the temporary locking position in the housing, the temporary locking protrusions of the housing are engaged with the temporary locking stoppers of the terminal locking member, while the temporary-locking locking sections of the housing are engaged with the locking portions of the flexible arms, so that the terminal locking member is held at the temporary locking position in the housing. Under this condition, the flexible arms are forcibly bent to disengage the locking portions from the temporary-locking locking sections, and the terminal locking member is further pushed in the cavity to the final locking position in the housing. As a result, the locking portions are engage the final locking recesses, thereby fixing the terminal locking member at the final locking position. The terminal locking member will not be unintentionally moved from the temporary locking position to the final locking position.

What is claimed is:

1. A connector for receiving a plurality of terminals, comprising:

a housing defining a plurality of terminal accommodating chambers and a cavity, wherein each of the plurality of terminal accommodating chambers accommodates a respective one of the plurality of terminals, and wherein the cavity is formed in an outer wall of the housing and is extended across the terminal accommodating chambers; and a terminal locking member movably disposed in the cavity of the housing, the terminal locking member being movable between a temporary locking position in which the terminal locking member is not engaged with the respective terminals accommodated in the terminal accommodating chambers and a final locking position in which the terminal locking member is engaged with the terminals, wherein the terminals are retained in the terminal accommodating chambers when the terminal locking member is in the final locking position;

wherein the housing includes a temporary-locking locking section formed along an upper edge of a wall of the housing adjacent to the cavity, a temporary locking protrusion formed on an inner surface of the wall, and a final locking recess formed in the wall above the temporary locking protrusions; and wherein the terminal locking member includes a temporary locking stopper engageable with the temporary locking protrusion to retain the terminal locking member in the cavity, and a flexible arm having a locking portion at an end thereof, the locking portion engageable with the temporary-locking locking section to lock the terminal locking member at the temporary locking position and engageable with the final locking recess to lock the terminal locking member at the final locking position.

2. The connector as claimed in claim 1, wherein the terminal locking member includes a second flexible arm, each of the flexible arms being formed on opposing side walls of the terminal locking member.

3. The connector as claimed in claim 2, wherein each flexible arm has a respective locking portion formed at an outer end portion thereof, each locking portion having a respective operating portion formed at an upper end portion of the locking portion.

4. The connector as claimed in claim 1, wherein the flexible arm is forcibly bendable to disengage a distal end of the flexible arm from the temporary-locking locking section to allow movement of the terminal locking member from the temporary locking position to the final locking position.

5. The connector as claimed in claim 1, wherein the flexible arm is cantilevered.

* * * * *

UNITED STATES PATENT AND TRADEMARK OFFICE

CERTIFICATE OF CORRECTION

PATENT NO. : 5,848,919

DATED : December 15, 1998

INVENTOR(S) : Toru Nagano

It is certified that error appears in the above-indentified patent and that said Letters Patent is hereby corrected as shown below:

Column 8, line 21, change "protrusions" to --protrusion--.

Signed and Sealed this

Eighteenth Day of May, 1999

*Attest:*

Q. TODD DICKINSON

*Attesting Officer*

*Acting Commissioner of Patents and Trademarks*